US012195234B2

(12) United States Patent
Urban

(10) Patent No.: US 12,195,234 B2
(45) Date of Patent: Jan. 14, 2025

(54) MODULAR CHANNEL PANEL

(71) Applicant: Jesse Urban, Plainfield, WI (US)

(72) Inventor: Jesse Urban, Plainfield, WI (US)

( * ) Notice: Subject to any disclaimer, the term of this patent is extended or adjusted under 35 U.S.C. 154(b) by 155 days.

(21) Appl. No.: 17/957,898

(22) Filed: Sep. 30, 2022

(65) Prior Publication Data

US 2024/0109686 A1 Apr. 4, 2024

(51) Int. Cl.
*B65D 25/06* (2006.01)

(52) U.S. Cl.
CPC .... *B65D 25/06* (2013.01); *B65D 2501/24063* (2013.01)

(58) Field of Classification Search
CPC ..... B65D 25/06; B65D 25/04; B65D 25/10; B65D 25/107; B65D 2501/2421; B65D 2501/24063
See application file for complete search history.

(56) References Cited

U.S. PATENT DOCUMENTS

| | | | | |
|---|---|---|---|---|
| 2,068,812 | A | 1/1937 | Miller | |
| 3,655,114 | A | 4/1972 | Turner | |
| 4,029,209 | A | 6/1977 | Frahm | |
| 4,190,172 | A | 2/1980 | Box | |
| 4,932,548 | A * | 6/1990 | Bensinger | F25D 23/069 206/509 |
| 5,071,026 | A | 12/1991 | Apps | |
| 8,887,916 | B2 * | 11/2014 | Gilfert | B65B 21/24 53/448 |
| 9,096,349 | B2 | 8/2015 | Youell | |
| 9,758,273 | B2 | 9/2017 | Youell | |
| 10,077,553 | B2 | 9/2018 | Neumayr | |
| 10,486,860 | B2 | 11/2019 | Frankenberg | |
| 2007/0257040 | A1 * | 11/2007 | Price, Jr. | B65D 81/263 220/507 |
| 2022/0281641 | A1 | 9/2022 | Urban | |

* cited by examiner

*Primary Examiner* — Andrew T Kirsch
(74) *Attorney, Agent, or Firm* — Carlin Law LLC

(57) ABSTRACT

A divider panel having a top end with an angled v-cut portion, a bottom end with an open slot and an angle v-cut portion, and a plurality of side walls, said divider panel additionally having a plurality of raised projections spaced out such that a horizontal channel and a vertical channel is formed between the projections. Two or more divider panels may be provided which removably mate together and thus create an interlocking panel shape. The dividers are placed within an existing shipping container or crate, and thus the shipping container has different chambers therein for the insertion of internal material such as fruit, vegetables, or nuts to be segmented into each of the different compartment segments. The channel or channels allows the free flow of air or liquid therein to allow for quick washing and uniform freezing of the internal material while in the shipping container.

18 Claims, 9 Drawing Sheets

MODULAR CHANNEL PANEL

FIELD

The present disclosure is directed to the field of shipping and packaging, and more particularly to Modular Channel Panels which are used for separating and disjoining batch material with regard to when said material is placed within a shipping or packaging container.

INTRODUCTION

The fruit processing industry frequently utilizes containers such as heavy wooden crates for their transportation and storage of fruit.

There are currently many in-process variables that cause yield fluctuation throughout a manufacturing day. One of the largest reasons for destroyed product, or scrap, is that the quality of the product itself has degraded to an unusable condition. When dealing with certain fresh foods such as fruits, vegetables, peanuts, and tree nuts for example, harvested fresh food gets stored until packaged or further processed. A current method utilized to maintain food integrity and freshness throughout storage and transportation, up to thawing and processing is to freeze the food product.

One of the most common approaches utilizes stacking wooden bins, or crates, filled with raw fruit into a fan circulated freezer area. An unintended consequence of this stacking method is that the fruit packed on the walls of the exterior of the bins is frozen quickly, though the fruit in the center of the binned fruit mass maintains its heat and moisture, delaying freezing. This results in a lot of fruit scrap, which must be dispensed of, as the quality of this material is degraded due to the maintaining moisture, and only a percentage of the originally binned material can be saved.

Unfortunately, many fruit processors do not have a large amount of capital to invest in different methods of freezing. Additionally, an abundance of labor would be required to transport arriving material and restacking to a different container for freezing, then restacking the frozen material back into the original container, should a different storage container be desired.

Further, the cost required to create new containers with dividers is untenable for many small to mid-size companies.

What is needed, is a device and method therefore which can increase the consistency of freezing as to the center mass of material within a storage container, and further so that current containers can be utilized while decreasing load filling time of storage containers as to product.

BRIEF SUMMARY OF THE INVENTION

The present disclosure is directed to a Modular Channel Panel for the rapid storage, separation, and filling of product within containers of which may be utilized in a shipping or freezing capacity.

The Modular Channel Panel of the present disclosure provides at least one panel, generally known herein as a durable panel comprised of a solid material structure such as plastic, metal, glass, silicone, bamboo, wood, or the like.

Said panel consists of a top wall, a bottom wall, a plurality of side walls, and an open slot located on or near the bottom wall. The panel will also have a first, or front, face, and a second face, otherwise known as a rear face. The open slot extends from the bottom wall upwardly towards the top wall, encompassing a portion of the panel itself, and is defined within a slot wall.

Upon the first, or front, face are a plurality of raised projections, each having a top end, a bottom end, and a plurality of side ends, with rounded, or curved, corners. The raised projections are extended away from the face wall at a distance known as the raised projection width. These raised projections are dispersed and positioned on the face in a pattern spaced out, such that between said projections, a lowered portion known as a channel is created. The particular width of the raised projections and the specifics of the deployed patterns are more impactful depending on the particularities of the use and the material contemplated. It is presently thought that the patterns of raised projections are stacked in such a way a channel exists in both the horizontal and the vertical, or the X-axis and the Y-axis. In such a fashion, a channel is presented surrounding each raised projection.

In a similar fashion, upon the second, or rear, face are a plurality of raised projections, each having a top end, a bottom end, and a plurality of side ends. These raised projections are also dispersed and positioned upon the second face in such a pattern where a channel, or channels are created near or surrounding the raised projections.

At the top wall of the Modular Channel Panel exists an angled V-Cut portion. This V-Cut may be at a 140-degree angle, more or less, such that the angled side walls of the V-Cut are recessed from the plane of the top wall. This recessed V-Cut will permit product to flow between the chambers, which are created by interlocking two or more Modular Channel Panels, so as to reduce fill times when loading a container with product.

There are multiple different shapes of raised projections which could be utilized within the scope of the present disclosure. Depending on the particular application, various shapes can be deployed. A square, a rectangle, a quadrilateral shape, or an abstract shape may be utilized to create a grid pattern, otherwise known as a crosshatch pattern. This will allow for an even distribution and uniform projection height, otherwise known as a projection plane, creating a dual linear channel both in the horizontal and the vertical axis. The dual linear channels prevents product from becoming compressed and ruined within different projection widths or heights while in transit.

A roundabout intersection is created within the intersection point of four projections, where a general circular portion is created upon the exposed face wall, absent any projection material. This roundabout is created within the meeting intersection of the projection rounded corners upon the edges of said projections, so as to help prevent debris and undersized material from entering and clogging the channels, while also allowing a substantial portion of air to flow unimpeded.

Additionally, within the roundabout portion is a roundabout redirection spire, known as a freestanding portion of material, projected outwardly within the center of the roundabout from the face. This creates a material portion, such that the product moving within the channels to maneuver around said spire in a circular path, similar to a traffic roundabout.

Within these channels, air can be naturally or artificially pushed therethrough, to allow a consistent amount of air to be passed to and through the core of the material located in the product mass. Further, material positioned therein can be washed and water can be quickly removed from the shipping container by way of the channels. Preferably, the previously mentioned raised projections have enough raised projection width to allow for the product to be positioned away from the face of the panel, either the front face or the rear face. Additionally, the raised projections are positioned apart enough such that a channel is created, while simultaneously positioned close enough to prevent product from entering the channels.

A second panel may be provided to create an interlocking panel shape to be utilized within a shipping container. A single panel could section the contents of a shipping container into two chambers, and the addition of a second panel may section the contents into four chambers.

As one with skill in the art of shipping and packaging would instantly recognize, a third panel may create six chambers, and so on. Should a third panel be utilized, it would necessitate that one of the panels comprises two open slots on the bottom end extending upwardly towards the top wall. This panel with two slots will then interact with the remaining two panels respectively. The number of additional panels is thus only limited by the number of slots contained within the primary panel itself.

As previously mentioned, product can be loaded within one chamber, and the V-Cut recessed portion allows for said product to overflow into the other chamber or chambers.

The slot of the Modular Channel Panel at the bottom wall is configured such that if a second panel were provided, the slot of the first panel would be received within the slot of the second panel, creating an interlocking panel shape, such as an 'X' shape, or a "+" shape. To create this shape, one of the two aforementioned panels would be inverted such that the bottom wall faces on the opposing end as to the opposing panel, and the slot is thus opened away from the ground. The opposing panel is then lifted and positioned over the slot such that the two slots are within the same vertical axis. The two slots are then adaptably received, creating the X or the Plus/Cross shape as desired. The bottom wall slot additionally comprises a lower angle V-Cut with the slot, similar to the top wall V-Cut.

In another aspect, a method of assembling a divider partition comprises a variety of steps. One will need to have a shipping container such as a box, or a crate. Next, the divider panels as previously described will be gathered, and adaptably received and mated by way of the open slots in each panel. It is also contemplated that the panels could be joined together by way of fasteners and plates, or other like means, either end to end or top to bottom to cover a larger container space. Whichever way the panels are joined, mated, or fastened together, the panels will create an interlocking panel shape, which is directly dependent upon the number of panels. After assembling the interlocking panels, the Modular Channel Panel will be placed within the shipping container, which creates a plurality of chambers. Once in place, material is added to the shipping container, and thus the chambers therein. The material can be of any type which is desired to be transported and moved.

Presently, it is thought this disclosure would work well with smaller perishable items such as fruit that are typically individually frozen for later transport. Some examples of such fruit would be cranberries, blueberries, cherries, plums, limes, lemons, gooseberries, boysenberries, strawberries, oranges, and raspberries. All fruit or vegetable or the like need not be listed to be encompassed herein and many other types of individually frozen foods are contemplated but listing would be too exhausting.

A person with ordinary skill in the art of packaging or shipping would instantly recognize the many areas with which the present disclosure would be useful, particularly with storing, transporting and uniformly freezing said material, if desired. Continuing, the shipping container complete with the Modular Channel Panel and material therein is brought within a fan circulated freezer room. Fan circulated freezer room is a term used herein as the area with which the material is to be frozen or prepped for transportation. The material may then sit for a period until ready to be transported to another location. Water may be sprayed upon the material to clean it, with the excess water draining out by way of the previously mentioned channels on the modular panels. Further, air may be pushed through the channels by way of air supply lines or the like in order to ensure debris and undersized material is moved out of the channels, and to encourage uniform air and temperature reaching the center masses of material.

It is presently understood and specifically contemplated that this disclosure will lend itself to be utilized as permanent fixtures within shipping crates. Shipping crates are generally thought of as open boxes, wherein they comprise a front end, a back end, plurality of side ends, and a bottom end. A top end may be provided in some circumstances but is generally removable or have the capacity to open and reveal the volume therein. Thus, the Modular Channel Panel, or Modular Channel Panels as the case may be, can be formed or otherwise attached within the shipping crate for permanence.

Alternatively, the Modular Channel Panel may be deployed as a temporary fixture within standard shipping crates or other packaging containers. In such a fashion, the Modular Channel Panel is removable and can be inserted or placed within said packaging container prior to receiving material therein. After the transportation, freezing, or at a time determined feasible by a human user, the Modular Channel Panel may be removed and the material can then meld, merge, or amalgamate together.

To assist with the removal of the Modular Channel Panel while material is present, a panel opening, or a multitude thereof, is contemplated. These panel openings act as handles to carry the panels and can be used as attachment points for a gripping device such as a human hand, or mechanically, such as by way of a forklift. Thus, it is presently thought that a circular handle hole, of which is reinforced, may be used. To assist with a forklift, a plurality of openings near the corners of the top end of the panel and a plurality of openings near the bottom end of the panel may be used, such that the panels can be quickly stacked and moved. In such a manner, the Modular Channel Panel, or Modular Channel Panels, within a shipping container surrounded by material can be more easily removed therefrom, as well as more easily stored and transported.

The Modular Channel Panels may be stored in unison by way of stacking. To assist with the stacking, upon each panel a plurality of indent buttons may be provided. These indent buttons are on one of the panel faces, and on the opposing face indent receivers are provided. The receivers are known as a recessed portion, wherein the indent buttons of the opposing face wall of another panel can mate. This allows for ease of stacking, and thus many panels can be moved with a single forklift by positioning the forks of the forklift through the panel forks openings.

These and various other features, advantages, modes, and objects of the present invention will be made apparent from the following detailed description and any appended drawings.

BRIEF DESCRIPTION OF THE SEVERAL VIEWS OF THE DRAWING

One or more preferred exemplary embodiments of the present disclosure are illustrated in the accompanying drawings in which like reference numerals represent like parts throughout and in which.

Before explaining one or more embodiments of the disclosed invention in detail, it is to be understood that this invention is not limited in its application to the details or modes of construction and the arrangement of the components set forth in the following description or previously disclosed illustrations. This invention is capable of multiple embodiments and modes, which can be practiced or carried out in many various ways. Also, it is to be understood that the phraseology and terminology employed herein is for the purpose of description, and should not be regarded as limiting, or used as an absolute.

DETAILED DESCRIPTION OF THE INVENTION

Figure 1:
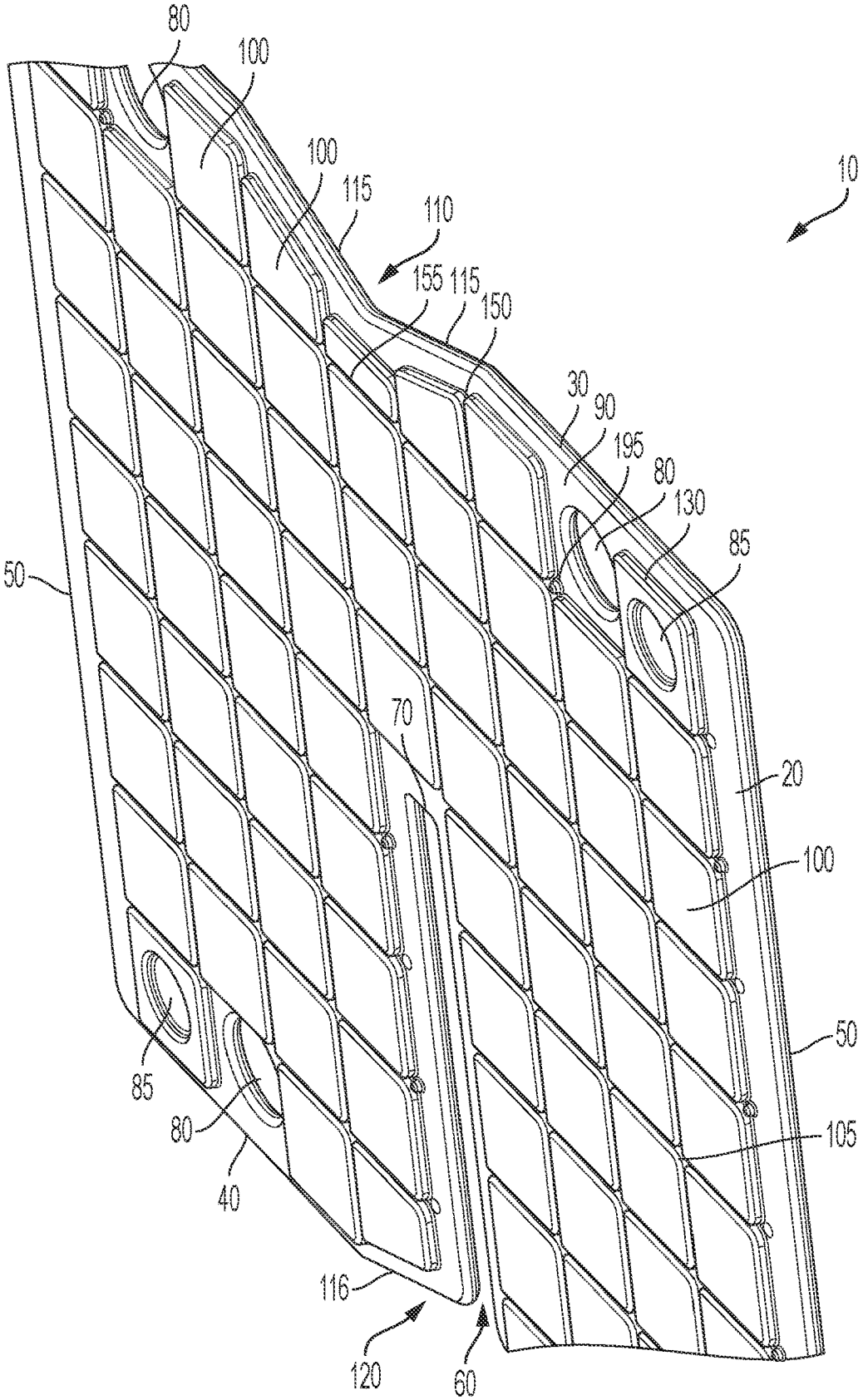
FIG. 1 is a perspective view of a preferred embodiment of the Modular Channel Panel.

Referring now to the drawings in detail, FIG. 1 illustrates a preferred embodiment of a Modular Channel Panel 10 constructed in accordance with the present disclosure. Shown here is a panel 20 highlighting the front face wall 90. The panel 20 consists of a top wall 30, a bottom wall 40, and two side walls 50. The top wall 30 additionally comprises an angled V-Cut 110, which here the two V-Cut side walls 115 create an approximately 140-degree angled portion, though it is known that larger or smaller angles are within the spirit of this disclosure.

Similarly, the bottom wall 40 has a lowered angle V-Cut 120, where the lower V-Cut side walls 116 create an angled portion. Within the lower angle V-Cut 120 is an open slot 60, extending from the bottom wall 40 upwardly to a point now as the slot wall 70, which defines the area of the open slot 60. As will be shown and appreciated later, the open slot 60 allows for mating of panels 20.

The raised projections 100 upon the panel 20 extend beyond the face wall 90, creating a raised projection width 130. The raised projections 100 are shown in a grid pattern, or a crosshatch pattern, of which creates both a uniform horizontal channel 155, as well as a uniform vertical channel 150. The raised projection width 130 may be increased or decreased, which in turn creates a deeper or shallower vertical channel 150 or horizontal channel 155, for ease of air to travel therethrough.

Near both the top wall 30 and the bottom wall 40 are a plurality of panel fork openings 80. These reinforced fork openings 80 allow for the ingress and egress of forklift forks for the ease of transportation. Additionally, the fork openings 80 may allow for placement and removal of panel 10 by hand or hook.

Figure 3:
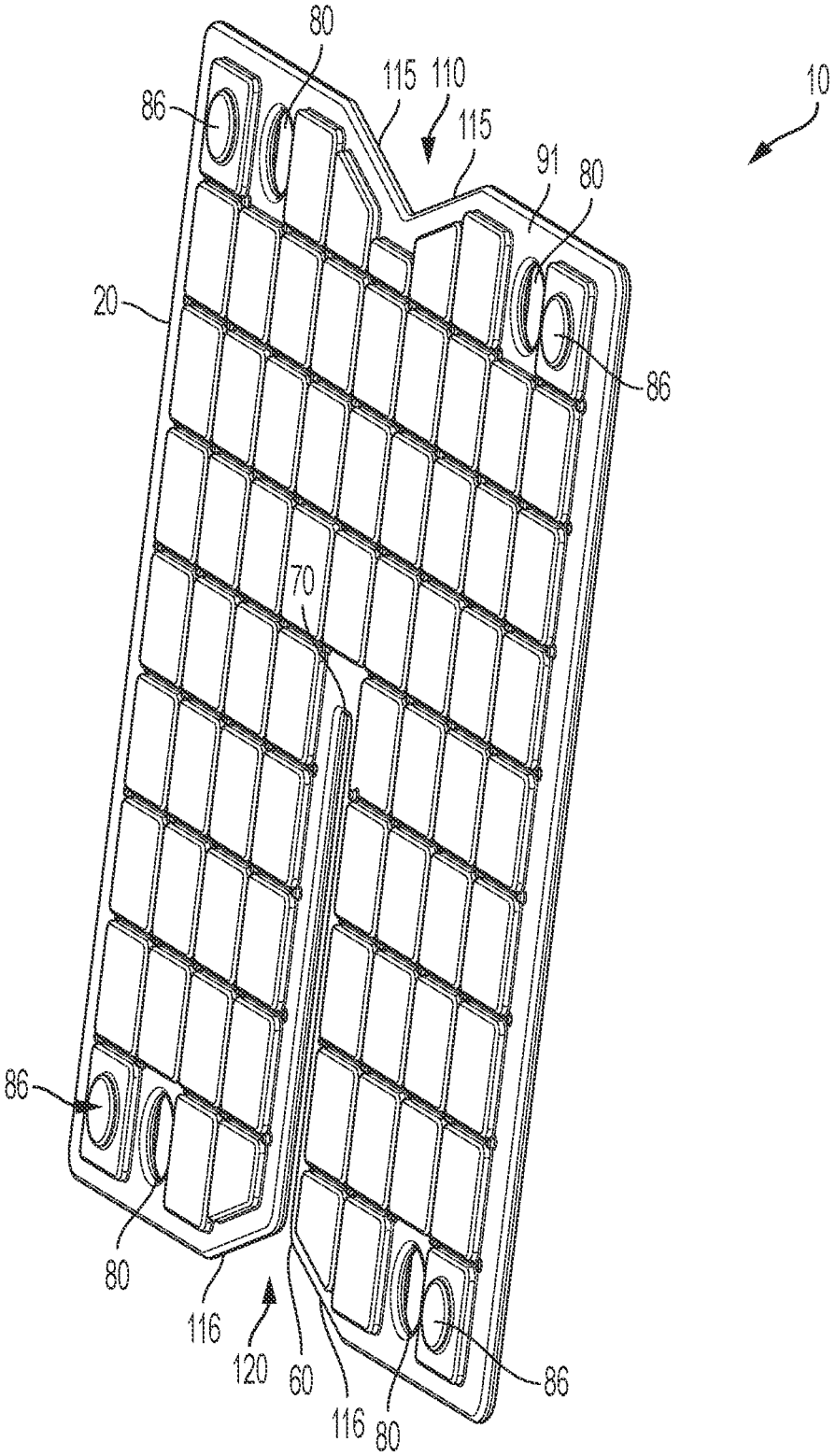
FIG. 3 is a perspective side view of a preferred embodiment of the Modular Channel Panel with the rear face of the panel shown.

Also located near both the top wall 30 and the bottom wall 40 are a plurality of circular indent receivers 85. These indented portions coincide with the circular indent buttons 86 as shown in FIG. 3 for ease of stacking and storage. Additionally, a forklift may then move a large quantity of Modular Channel Panels 10 by way of inserting forklift forks through the panel fork openings 80 of the plurality of panels 20.

Figure 2:
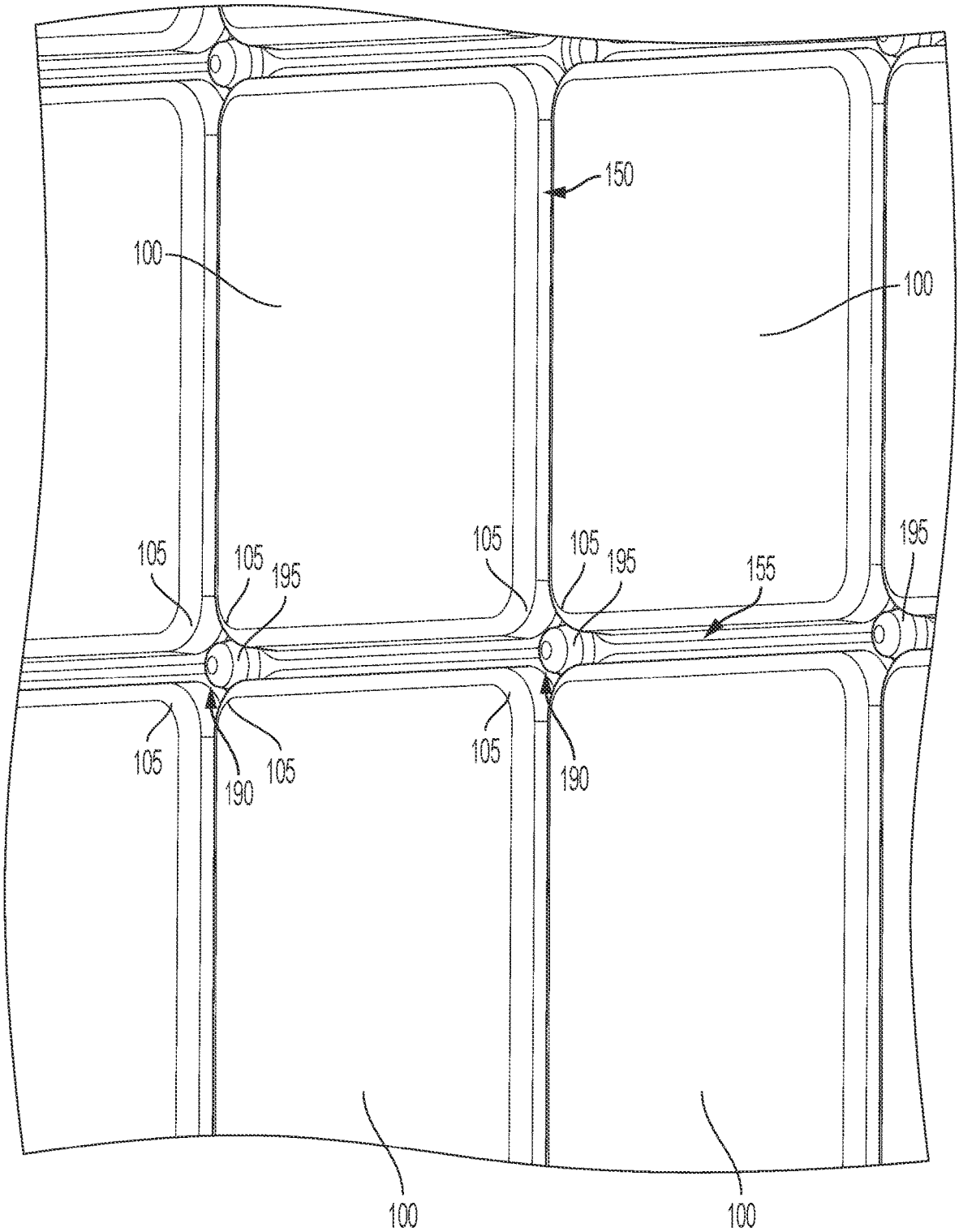
FIG. 2 is a close-up view of the roundabout intersection of the Modular Channel Panel highlighting redirection spires therein.

Turning now to FIG. 2, the Modular Channel Panel 10 is shown in a close-up view, highlighting the raised projections 100. These projections 100 have rounded corners 105, which creates a four-way angled intersection between four projections 100, known as a roundabout intersection 190. These roundabout intersections 190 are the points where a horizontal channel 155 connects to a vertical channel 150. To prevent plugging, or the clogging of water, air, or material, and to increase the efficiency of said travel within this roundabout intersection 190, a redirection spire 195 is placed within the center of said roundabout intersection 190. The redirection spire 195 is known as an extended piece of material extending beyond the panel 20 face. In such a fashion, undersized material, water, or air will move along a channel, contact the redirection spire 195, and travel either horizontally or vertically therefrom. This additional feature of the redirection spire 195 prevents debris, or undersized material, which did in fact ingress a channel from free flowing unimpeded. It may also encourage such interloping material to exit the channel thereof.

Figure 4:
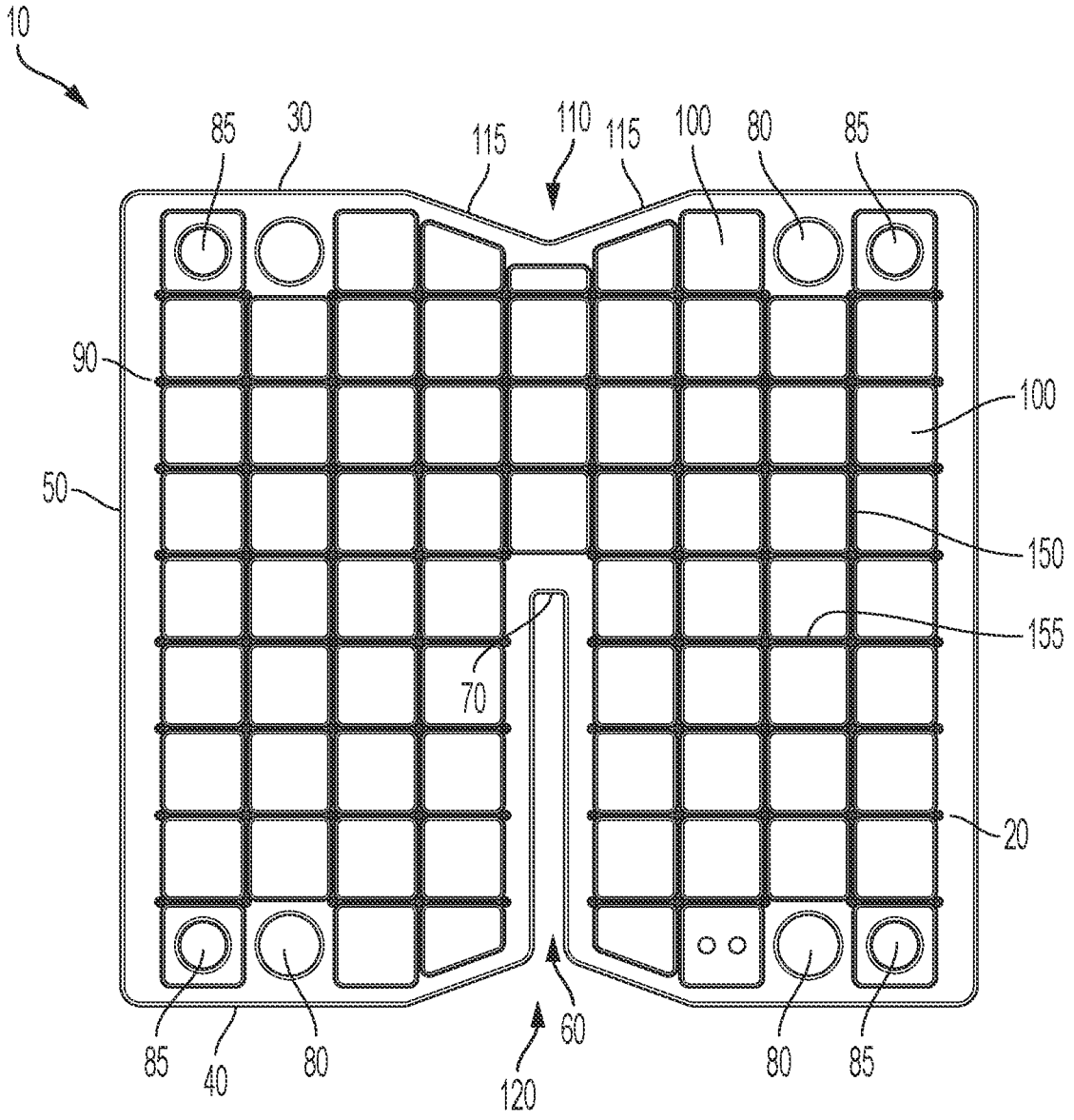
FIG. 4 is a perspective side view of a preferred embodiment of the Modular Channel Panel with the front face of the panel shown.

As shown in FIG. 3, the opposing or rear face 91 of the modular panels 20 is similar to the front face 90, excepting that a circular indent button 86 is provided in the corners near the top wall 30 and the bottom wall 40, which allows for mating with a second panel 20 front face 90 by way of the other panel's circular indent receivers 85, as highlighted in FIG. 4.

Staying with FIG. 4, a close-up view of the Modular Channel Panel 10 is shown, highlighting the circular indent receivers 85. By way of explanation, the raised projections 100 are as viewed from the lower portion of the modular panel 20 itself, the panel face 90. As previously mentioned, the panel face 90 may be either the front face or the rear face of a modular panel 20, otherwise known as the front face or the rear face thereof. The positioning of the raised projections 100 as well as the projection width 130 thereof allows for the creation of a vertical channel 150, as well as a horizontal channel 155, generally surrounding each raised projection 100.

As defined herein, a channel is the portion between raised projections 100, which will allow for product, air, water, or the like to flow through and around the raised projections 100. However, preferably the channel is of such width, height, and depth such that debris and most of the material which may be contained within a shipping container 160 cannot ingress. Instead, air is allowed to travel along the channels for ease of freezing or circulation within the chambers.

As is appreciated by those with skill in the art, particularly the art of shipping or packaging, the farther the raised projections 100 are placed from each other, the wider the vertical channel 150 and horizontal channel 155 width shall become.

Figure 5:
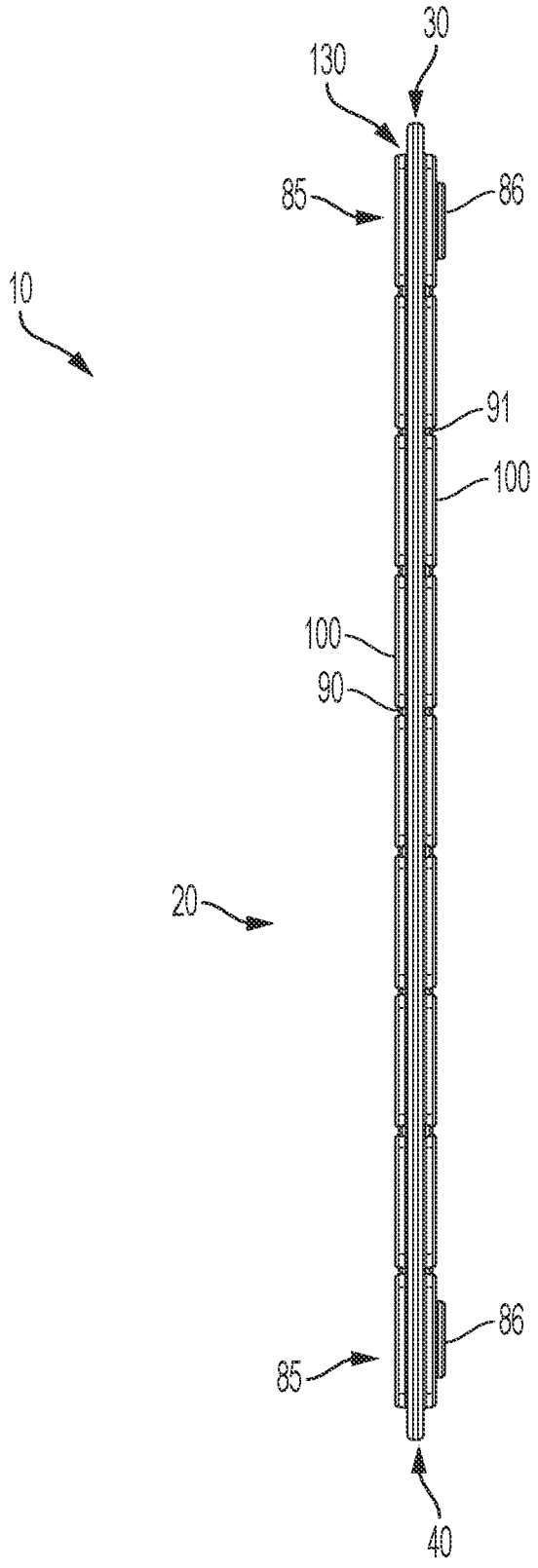
FIG. 5 is a side view of the raised projections of an embodiment of the Modular Channel Panel.
Figure 6:
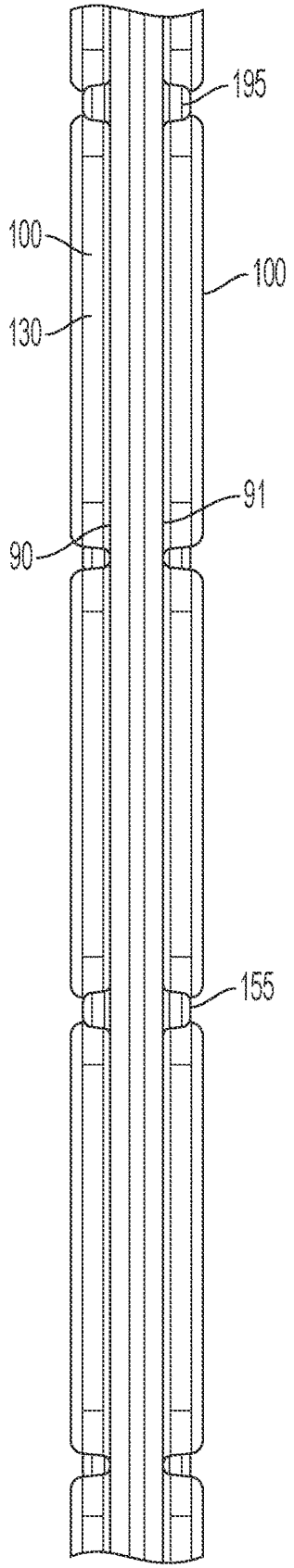
FIG. 6 is a perspective side view of a preferred embodiment of the Modular Channel Panel highlighting the spires and projection widths.

FIG. 5 and FIG. 6 illustrate a side view of an embodiment of the raised projections 100 and the projection width 130 of the present disclosure. The raised projections 100 extend away from the face wall 90 as described above in a distance described herein as the raised projection width 130. The width of the projections 100 may be adjusted based on use. While the particular design of the raised projections 100 may vary, this particular embodiment highlights raised projection width 130, and additionally allows visualization of circular indent buttons 86 on the rear face wall 91, and the circular indent receivers 85 on the front face wall 90. Additionally, the redirection spires 195 are shown with a raised height thereof, as from either the front face 90 or the rear face 91.

Figure 7:
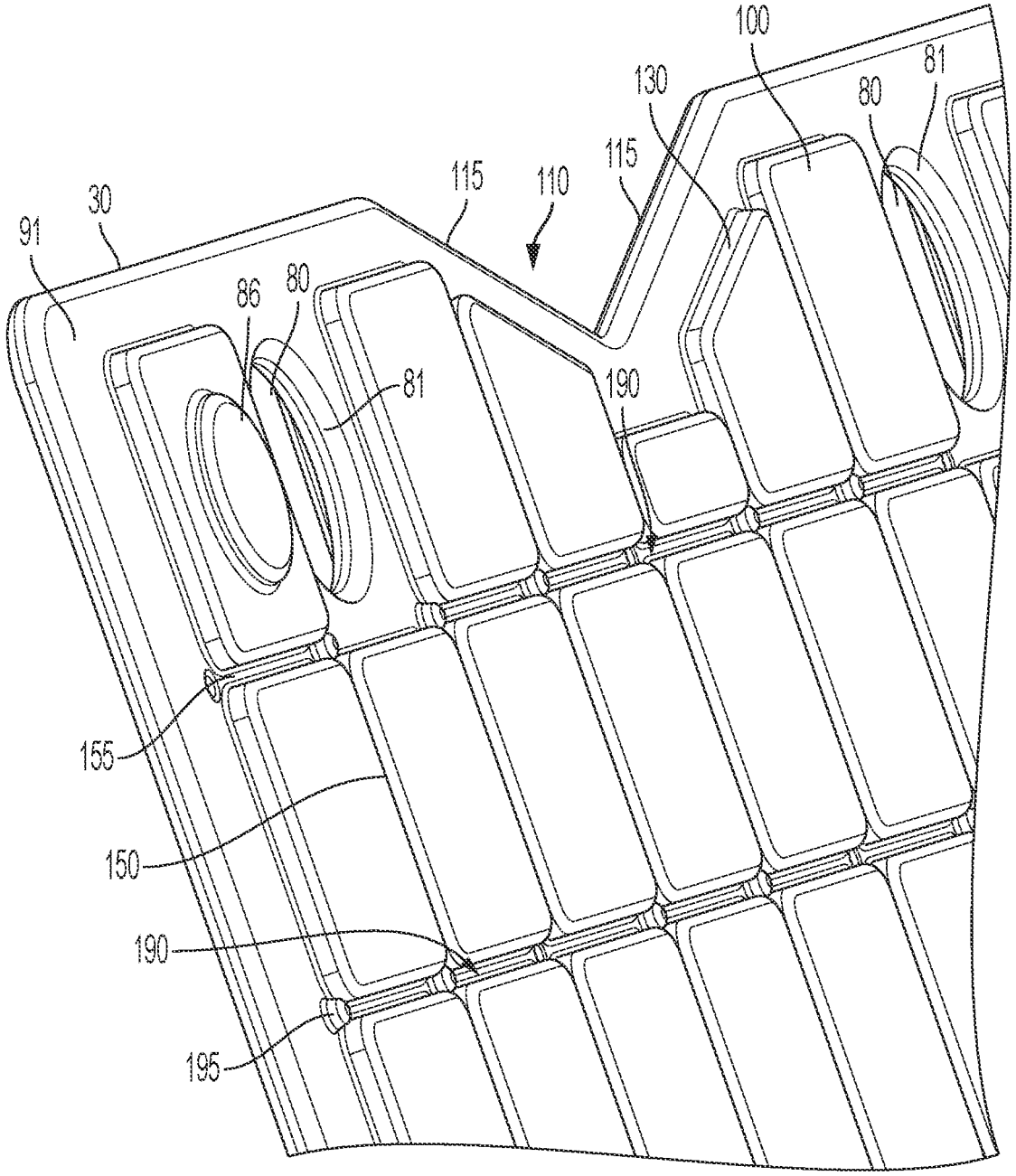
FIG. 7 is a close-up view of a preferred embodiment of the Modular Channel Panel wherein the rear face panel is shown with a multitude of open slots, each having reinforced material therein.

Now looking at FIG. 7, a close-up view of the rear face 91 of the panel 20 is shown, highlighting a circular indent button 86. It is readily apparent that the roundabout intersections 190 are positioned at the intersection of each horizontal channel 155 and vertical channel 150, with a roundabout redirection spire 195 located therein. Also shown is the reinforced material 81 within the panel forks opening 80, defined as extra material around the circumference of said panel forks opening 80, to allow for durability during transportation of the Modular Channel Panels 10, particularly when stacked in plurality.

Figure 8:
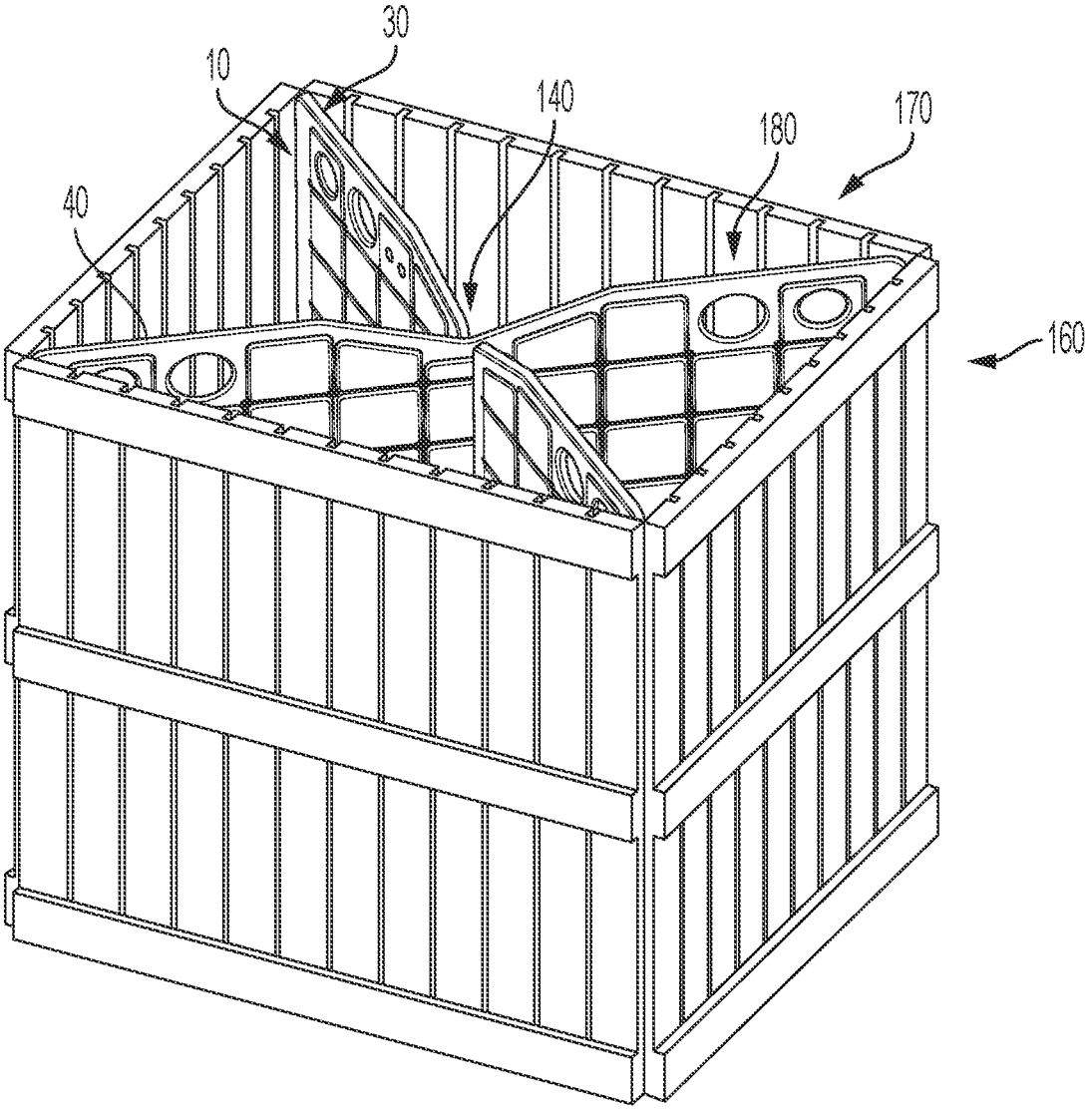
FIG. 8 is a perspective view of a preferred embodiment of the Modular Channel Panel wherein the Modular Channel Panel is interlocked an in an "X" position with a second Modular Channel Panel and positioned within a shipping container.

FIG. 8 highlights a shipping container 160 wherein two Modular Channel Panels 10 are positioned therein. This further illustrates a preferred embodiment of a Modular Channel Panel 10 constructed in accordance with the present disclosure, which retrofits existing containers. Shown here are two modular panels 20 that are deployed in an interlocking panel shape 170, which as shown here is a "X" or a "+" shape. In such a fashion, the modular panels 20 may be removably attached for ease of access, cleaning, as well as for maintenance. These modular panels 20, will thus have the ability to assemble into an interlocking panel shape 170 of the Modular Channel Panel 10. The slot wall 70, as defined herein, is the most upwardly point of the open slot 60 as from the panel bottom wall 40. Further, the slot wall 70 are where two or more modular panels 20 meet and join when forming an interlocking panel shape 170. As discussed above, the modular panels 20 here are deployed in opposing positions, such that the open slot 60 is shown on opposing sides, to effectuate the mating of the modular panels 20, creating an inverted connected panel 180, where the bottom wall 40 of one panel 20 is on a panel of the top wall 30 of the second panel 20. The creation of the interlocking panel shape 170 as shown here creates four chambers 140, or areas for product or material to be stored. As described above, due to the channels and positioning within a current shipping container 160, material stored therein is able to be separated from the center of said shipping container 160, allowing for air to travel to all parts of the stored material or product. This, as is known by those with skill in the art, will prevent spoilage and uneven temperature distribution within said shipping container.

Figure 9:
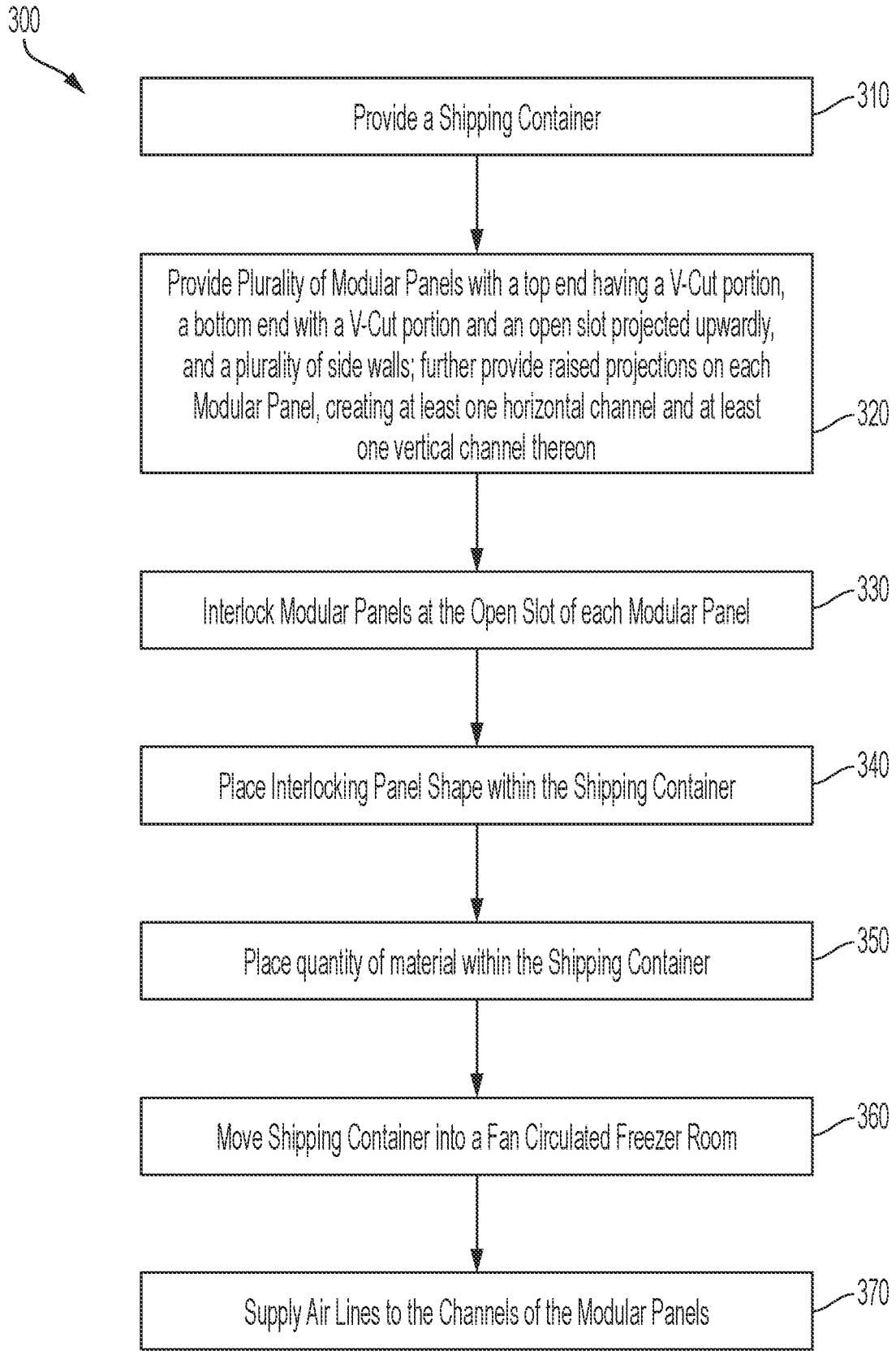
FIG. 9 illustrates a method of assembling a Modular Channel Panel within a shipping container for use with fruit contained within a fan circulated freezer room.

Last, we look at FIG. 9. A method 300 is displayed for a human user to freeze material within a shipping container by way of utilizing the present disclosure within an existing shipping container. The first step is to provide a shipping container 310. A plurality of modular panels as described herein is provided 320, each modular panel having V-Cuts, and raised projections as described, creating horizontal channels and vertical channels. The plurality of modular panels are then interlocked 330 by way of the open slot on each modular panel as described herein, creating an interlocking panel shape. This interlocking panel shape is then placed within the previously mentioned shipping container 340, creating different chambers therein. Now material, such as fruit, vegetables, or the like are added into the shipping container 350. Now that the shipping container is loaded, the shipping container is moved into a fan circulated freezer room 360. At this point, air lines are provided, sending air through the channels of the modular panels 370. In such a fashion, an air supply device will provide air circulation within at least one of the channels, allowing for air to reach the material located most centrally as viewed from the shipping container.

Understandably, the present Modular Channel Panel 10 has been described above in terms of one or more preferred embodiments or models. It is recognized that various alternatives and modifications may be made to these embodiments and methods that are within the scope of the present invention. Various alternatives are contemplated as being within the scope of the present invention. It is also to be understood that, although the foregoing description and drawings describe and illustrate in detail one or more preferred embodiments of the Modular Channel Panel 10, to those skilled in the art of which this invention relates, the present disclosure will suggest many modifications, models, and constructions, as well as widely differing embodiments and applications without thereby departing from the spirit and scope of the invention.

What is claimed is:

1. A container divider, comprising:

a panel having a front face, a rear face, a top wall, a bottom wall, and a plurality of sidewalls, wherein said bottom wall additionally comprises an open slot extending from said bottom wall upwardly;

a plurality of raised projections upon the panel front face and extending therefrom, said front face raised projections additionally comprise a top end, a bottom end, and a plurality of side ends;

wherein said front face raised projections are positioned such that a horizontal channel is formed therebetween;

wherein said front face raised projections are positioned such that a vertical channel is formed therebetween;

wherein at least one panel opening is positioned near the top end of the panel;

wherein at least one panel opening is positioned near the bottom end of the panel;

a plurality of raised projections upon the panel rear face and extending therefrom, said rear face raised projections additionally comprise a top end, a bottom end, and a plurality of side ends;

wherein said rear face raised projections are positioned such that a horizontal channel is formed therebetween;

wherein said rear face raised projections are positioned such that a vertical channel is formed therebetween;

wherein a roundabout intersection is created within an intersection point of the front face horizontal channel and the front face vertical channel; and wherein a roundabout intersection is created within an intersection point of the rear face horizontal channel and the rear face vertical channel.

2. The container divider of claim 1, wherein the raised projections are substantially square-shaped, said raised projections further comprising a plurality of rounded corners thereon.

3. The container divider of claim 2, wherein a raised redirection spire is positioned on the front face of the panel and extended outwardly therefrom, said redirection spire additionally located within the roundabout intersection between the rounded corners of a plurality of the square-shaped front face raised projections.

4. The container divider of claim 3, wherein a raised redirection spire is positioned on the rear face of the panel and extended outwardly therefrom, said redirection spire additionally located within the roundabout intersection between the rounded corners of a plurality of the square-shaped rear face raised projections.

5. The container divider of claim 4, further comprising a V-Cut portion on the top wall of the panel in a centrally located position thereon.

6. The container divider of claim 5, further comprising a V-Cut portion on the bottom wall of the panel in a centrally located position thereon.

7. The container divider of claim 6, wherein a second container divider panel is provided, said second container divider panel comprising a front face, a rear face, a top wall with a V-Cut portion thereon, a bottom wall with a V-Cut portion thereon, and a plurality of sidewalls, wherein said bottom wall V-Cut portion additionally comprises an open slot extending from said bottom wall upwardly, and said second container divider panel open slot is adaptably received within the open slot of the first container divider panel.

8. The container dividers of claim 7, wherein the second container divider panel additionally comprises a plurality of raised projections upon the panel front face and extending therefrom, said front face raised projections additionally comprise a top end, a bottom end, and a plurality of side ends, and further comprising a plurality of raised projections upon the panel rear face and extending therefrom, said rear face raised projections additionally comprise a top end, a bottom end, and a plurality of side ends.

9. The container dividers of claim 8, wherein the second container divider panel front face raised projections are positioned such that a vertical channel and a horizontal channel is formed therebetween, and further wherein the second container divider panel rear face raised projections are positioned such that a vertical channel and a horizontal channel is formed therebetween.

10. The container dividers of claim 9, wherein the first container divider panel additionally comprises a second open slot extending from said bottom wall upwardly, wherein said open slot is at a centrally located position on the bottom wall.

11. The container dividers of claim 10, wherein the raised redirection spires located on the panel front face are extended to a height that is less than that of the front face raised projections, and wherein the raised redirection spires located on the panel rear face are extended to a height that is less than that of the rear face raised projections.

12. The container dividers of claim 11, further comprising an indent button located on the rear face of the panel.

13. The container dividers of claim 12, further comprising an indent receiver located on the front face of the panel.

14. A container divider comprising:

A shipping container with a front end, a back end, two side ends, and a bottom end;

a plurality of modular panels contained within said shipping container, each of the plurality of modular panels having a top end, a bottom end, a plurality of side walls, a rear wall and a front wall;

an open slot at the bottom end of each modular panel, projected partially upwardly along the front wall and the rear wall, said open slot having 140-degree angle side walls;

a plurality of raised projections extending from the front wall of each modular panel, each raised projection having a top end, a bottom end, and a plurality of side ends, positioned such that a vertical channel is formed surrounding said raised projections and further such that a horizontal channel is formed surrounding said raised projections, wherein a roundabout intersection is formed between the intersection of the vertical channel and the horizontal channel;

a plurality of raised projections from the rear wall of each modular panel, each raised projection having a top end, a bottom end, and a plurality of side ends, positioned such that a vertical channel is formed surrounding said raised projections and further such that a horizontal channel is formed surrounding said raised projections, wherein a roundabout intersection is formed between the intersection of the vertical channel and the horizontal channel; and wherein one of the plurality of modular panels is adaptably received within the 140-degree open slot of said modular panel to the open slot of the second modular panel.

15. The container divider of claim 14, wherein the plurality of raised projections from the front wall of each of the modular panels, and the plurality of raised projections from the rear wall of each of the modular panels are substantially square-shaped and have rounded corners.

16. The container divider of claim 15, wherein each of the modular panels additionally comprise a plurality of panel fork openings positioned near the top end of each modular panel, and additionally comprise a plurality of panel for openings positioned near the bottom end of each modular panel.

17. The container divider of claim 16, wherein a roundabout redirection spire is positioned between each horizontal channel and vertical channel roundabout intersection point.

18. The container divider of claim 17, wherein the front wall of each modular panel additionally comprises an indent receiver, and further wherein the rear wall of each modular panel additionally comprises an indent button.

* * * * *